United States Patent [19]

Stemler et al.

[11] 4,003,603

[45] Jan. 18, 1977

[54] IMPACT MEANS FOR RIPPER

[75] Inventors: Orrin A. Stemler, East Peoria; Delwin E. Cobb, Peoria, both of Ill.

[73] Assignee: Caterpillar Tractor Co., Peoria, Ill.

[22] Filed: Dec. 1, 1975

[21] Appl. No.: 636,784

[52] U.S. Cl. ..... 299/37; 37/DIG. 18; 172/40; 173/100

[51] Int. Cl.[2] ..... A01B 35/00

[58] Field of Search ..... 299/14, 37; 173/100; 37/DIG. 18; 172/40

[56] References Cited

UNITED STATES PATENTS

| | | | |
|---|---|---|---|
| 3,527,501 | 9/1970 | Shatto | 299/37 |
| 3,770,322 | 11/1973 | Cobb et al. | 299/37 |
| 3,922,017 | 11/1975 | Cobb | 299/37 |

*Primary Examiner*—Ernest R. Purser

*Attorney, Agent, or Firm*—Wegner, Stellman, McCord, Wiles & Wood

[57] ABSTRACT

An earth working apparatus having a ripper for loosening earth and the like. An impact member is associated with the ripper to provide a cushioned transfer of impact force for improved earth working operation.

12 Claims, 2 Drawing Figures

IMPACT MEANS FOR RIPPER

BACKGROUND OF THE INVENTION

1. Field of the Invention

This invention relates to earth working apparatus and in particular to means for transferring an impact force from a force means to a ripper for loosening earth and the like.

2. Description of the Prior Art

In U.S. Pat. No. 3,770,322 of Delwin E. Cobb et al., owned by the assignee hereof, an improved apparatus for fracture of material in situ with stored inertial energy is disclosed. In one embodiment of the apparatus therein, a hammer is impacted against a ripper shank which is pivotally supported on a frame. The hammer is pivotally supported on the ripper shank. The impact surface of the hammer is shaped arcuately and engages the ripper shank in a groove thereof for reducing the possibility of rock and other material from coming between the impact surfaces.

The impact surfaces are shaped so that initial contact occurs near the center of rotation and then, as the shank and hammer deform the contact surface, expands toward the lower edge. The disclosed construction is provided to reduce the impact stress in effecting a cushioned impact wherein the initial impact velocity is reduced.

In the illustrated embodiment, the surface of the ripper shank engaged by the impact hammer is substantially straight and the impact force is delivered through a hammer toward the initial point of contact of the hammer surface with the ripper shank surface.

SUMMARY OF THE INVENTION

The present invention comprehends an improved earth working apparatus providing further improved cushioned impacting of the earth working ripper.

More specifically, the invention comprehends providing a ripper having a resiliently deflectible shank portion which is engaged by an impact member contact surface defining an outwardly widening gap in an original contact position. As the impact force is applied through the impact member, the resiliently deflectible shank portion deflects to cause the shank to be deflected and progressively increase gap-closing facial engagement with the impact member contact surface in transferring the impact force from the force means through the ripper deflectible portion to an earth engaging tooth thereon. As the deflection of the ripper shank is resilient and can be suitably controlled by the parameters of the shank construction, improved accurate cushioning of the impact force delivered to the ripper tooth is obtained while yet long trouble-free life of the apparatus is provided.

The apparatus is arranged so that upon substantial completion of the closing of the outwardly widening gap, a substantially direct force transmission from the force applying means to the ripper tooth is provided.

In the illustrated embodiment, the impact member is pivotally mounted to the frame, and more specifically, may be pivotally mounted to the frame by the same pivot means mounting the ripper to the frame.

In the illustrated embodiment, the contact surface of the impact member and the surface of the ripper shank engaged by the impact member contact surface are substantially planar.

In the illustrated embodiment, the application of the impact force to the impact member may be at an outer portion thereof so as to provide a substantial moment arm in the resilient deflection action providing the improved cushioned impact force transmission.

Thus, the earth working apparatus of the present invention is extremely simple and economical of construction while yet providing the highly desirable features discussed above.

BRIEF DESCRIPTION OF THE DRAWING

Other features and advantages of the invention will be apparent from the following description taken in connection with the accompanying drawing wherein.

DESCRIPTION OF THE PREFERRED EMBODIMENT

Figures 1, 2:
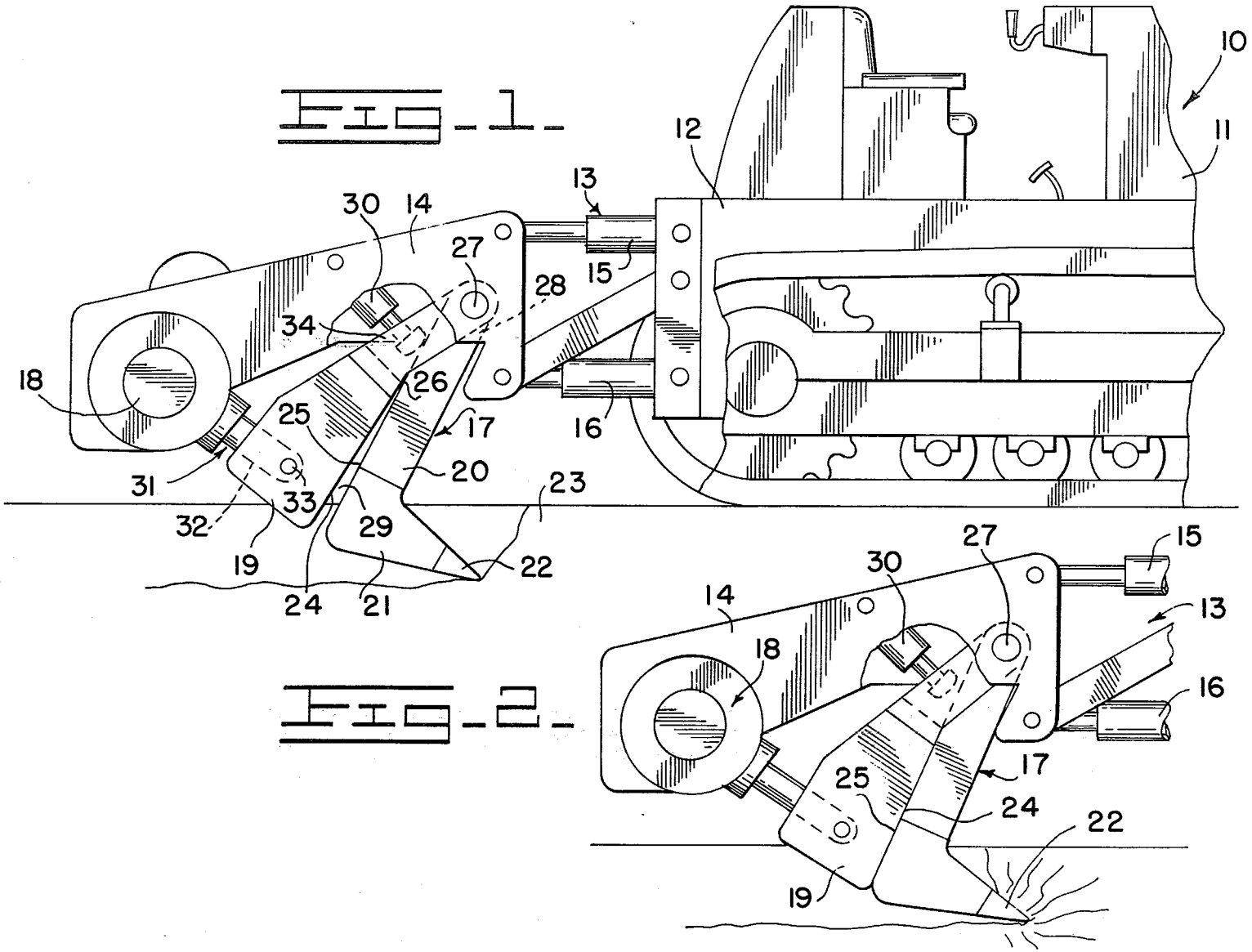
FIG. 1 is a fragmentary side elevation of an earth working apparatus having an improved cushioned ripper impact means embodying the invention.
FIG. 2 is a fragmentary side elevation illustrating the arrangement of the impact means as upon completion of the transmission of an impact force to the ripper portion of the earth working apparatus.

In the exemplary embodiment of the invention as disclosed in the drawing, an earth working apparatus generally designated 10 illustratively comprises a track-type vehicle 11 having a rear portion 12 carrying a support generally designated 13 including a frame 14. Support 13 includes a pair of fluid operated cylinders 15 and 16 which may be suitably operated to control the position of the frame in the use of the apparatus.

The present invention is concerned with the provision of a cushioned impact force to a ripper generally designated 17 from a force means generally designated 18 carried on the frame. The impact force is delivered to the ripper 17 through an impacting member 19 in a novel manner to provide an improved cushioned transmission of the impact force to the ripper.

More specifically, ripper 17 includes a resiliently deflectible shank portion 20 having a lower, or outer, end 21 provided with a suitable earth working element, such as tooth 22. In the ripping action, tooth 22 is urged into the earth material 23 intended to be ripped so as to loosen the earth. Where the earth 23 is rocky, or hard, it is necessary to fracture the earth by the delivery of high impact forces through the tooth 22. It is desirable to provide such high impact forces in a cushioned manner so as to provide relatively long life, maintenance-free operation of the force transmitting means while yet assuring the delivery of suitable high energy earth loosening forces by the apparatus.

To effect such cushioned impact force transmission herein, impact member 19 is arranged to provide a progressively increased facial engagement with the ripper shank whereby the impact force is progressively applied through the shank to the ripper tooth.

As shown in FIG. 1, the impact member defines a contact surface 24 confronting a rear ripper shank surface 25 and defining therewith an outwardly widening gap. Initial engagement of contact surface 24 with surface 25 is had at an inner position 26 with the shank in substantially undeformed condition.

The impact member may be pivotally mounted to frame 14 so as to swing toward and from shank surface 25. In the illustrated embodiment, the impact member is pivotally mounted to the frame on a pivot pin 27 which also pivotally mounts the inner end 28 of the ripper shank 20 to the frame. Thus, in the illustrated embodiment, the ripper and impact member are coaxially mounted to the frame.

In the illustrated embodiment, each of surfaces 24 and 25 is originally substantially planar. The angular gap 29 therebetween defines a preselected small angle. Thus, as an incident of the counterclockwise swinging of the impact member 19 by force means 18, the resiliently deflectible ripper shank portion 20 permits a progressively increased facial engagement of surface 25 by impact surface 24 until, as shown in FIG. 2, surfaces 24 and 25 are substantially fully engaged to permit a substantially direct force transmission from the force means 18 to the ripper tooth 22.

As can best be seen by consideration of the relative movement of the ripper and impact member between the positions of FIGS. 1 and 2, the amount of cushioning may vary as a direct function of the amount of resistance of the earth 23 to the penetration thereof by the tooth 22. Thus, where a low resistance occurs, the movement of ripper 17 is effected with minimal deformation of the shank 20, whereas, where a high resistance to penetration occurs, substantially full cushioning action to the fully surface-to-surface engaged position of FIG. 2 may be provided.

A cylinder 30 may be provided on frame 14 for dampening purposes and for urging the ripper to the earth-engaging position of FIG. 1 in the conventional manner.

Thus, the cushioning device of the present invention defines a dynamic mechanical system for applying vibratory energy to the earth working tooth implement. The ripper effectively defines a generally upright impacted member arranged to receive vibratory energy from the dynamic system. The ripper member and impact member define substantially coextensive impact transmitting surfaces in the deflected arrangement of the ripper whereby the impact velocity between the members and stresses in the members are effectively minimized.

In the illustrated embodiment, the force means 18 may comprise a rotating crank and flywheel device which stores energy in substantial amounts for delivery through the impact member 19 to the ripper. The force means may include a transmission portion 31 including a connecting rod 32 and a pivot pin 33 connected to the impact member.

In the illustrated embodiment, the impact member may include a bifurcated upper portion 34 straddling the inner portion 28 of the ripper shank for facilitated assembly of the members on the pivot pin 27 on frame 14.

In the illustrated embodiment, the impact member is relatively rigid. As will be obvious to those skilled in the art, the impact member may have a limited resilient deflectibility so as to cooperate with the resiliently deflectible shank portion 20 of the ripper in effecting the desirable progressive gap-closing cushioning action in the transmission of the impact force. More specifically, where the shank portion 20 is relatively stiff, the shank may bow somewhat as the point of contact of the surface 24 moves downwardly toward the lower end 21 of the shank whereby the shank is deflected into interrupted progressively increased gap-closing facial engagement. Where the shank is more resilient, the progressive increase in the facial engagement may be continual from the initial point of contact 26 to the final fully engaged arrangement of FIG. 2. Thus, in describing the engagement of the impact member with the shank surface 25, the progressively increased gap-closing facial engagement is defined herein as selectively interrupted or continual as a function of the resiliency of the shank portion 20 of the ripper 17.

In the observed functioning of the invention, the bowing of the shank 20 is extremely slight so that the progressive engagement may occur with limited interruption. A highly desirable advantage of the progressive engagement provided by the apparatus of the present invention resides in the reduction in noise in the use thereof as compared to conventional impact devices of this type wherein a sudden striking force is generated producing high noise levels. The importance of sound pollution prevention is becoming increasingly greater and, thus, the present invention provides a further highly desirable advantage in this respect.

The foregoing disclosure of specific embodiments is illustrative of the broad inventive concepts comprehended by the invention.

We claim:

1. In an earth working apparatus having a support, a ripper defining a resiliently deflectible shank and a tooth at one end of the shank, and an impact member having an inner mounting portion and an outer impacting portion, the improvement comprising:

pivot means for pivotally mounting the ripper shank to the support for pivoting about a single pivot axis;

pivot means for pivotally mounting the impact member mounting portion to the support for pivoting about a single pivot axis with said impacting portion defining a contact surface engaging said shank at an inner portion in an undeflected condition of said shank and defining therewith an outwardly widening gap; and impact force means for urging the impact member outwardly of said inner portion toward said shank with said tooth engaging earth to be loosened to cause said shank to be deflected into progressively increased gap-closing facial engagement with said contact surface in transferring an impact force from said force means through said deflectible portion to said tooth.

2. The earth working apparatus of claim 1 wherein said contact surface is substantially planar.

3. The earth working apparatus of claim 1 wherein said force means is arranged to act against an outermost portion of said impact member.

4. The earth working apparatus of claim 1 wherein said impacting portion of the impact member is resiliently deflectible whereby said contact surface deflects toward said shank in transferring an impact force thereto.

5. In an earth working apparatus having a ripper defining a resiliently deflectible shank and a tooth at one end of the shank, and an impact member having an inner mounting portion and an outer portion, the improvement comprising:

first pivot means for pivotally mounting the ripper shank for pivoting about a pivot axis;

second pivot means for pivotally mounting the impact member mounting portion coaxially to the first pivot means for pivoting about a coaxial pivot axis with said impacting portion adjacent said ripper shank, said impacting portion defining a contact surface engaging said shank at an inner portion in an undeflected condition of said shank and defining therewith an outwardly widening gap; and impact force means for urging the impact member outwardly of said inner portion toward said shank with said tooth engaging earth to be loosened to cause said shank to be deflected into progressively increased gap-closing facial engagement with said contact surface in transferring an impact force from said force means through said deflectible portion to said tooth.

6. The earth working apparatus of claim 5 wherein both of said pivot means are defined by a pivot pin pivotally mounting each of said ripper shank and said impact member mounting portions.

7. The earth working apparatus of claim 5 including a mounting frame, each of said pivot means and impact force means being mounted to said frame.

8. The earth working apparatus of claim 5 including a mounting frame, each of said pivot means, said impact member mounting portion, and impact force means being mounted to said frame.

9. A device for use in a dynamic mechanical system applying vibratory energy to an implement for earth working, said device comprising:

a frame for said dynamic mechanical system carried by a motor vehicle;

a generally upright impacted member including an upper end and an earth engaging lower end;

first pivot means on the frame supporting the upper end of the impacted member for pivoting about a first pivot axis;

a generally upright impacting member in a coacting relation with said impacted member; and second pivot means on the frame supporting said impacting member for pivoting about a second pivot axis coaxial with said first pivot axis, said inpacting member being arranged to receive vibratory energy from dynamic system and to deliver the energy to said impacted member, said members having coextensive impact transmitting surfaces, said surfaces generally extending toward and away from the pivot supports of said members with an initial contact area at end of the surfaces closest to the pivots and diverging out of contact at a small acute angle from said initial contact area, said impacted member being bendable under impacting forces to bring said impact transmitting surfaces into coextensive face-to-face force transmitting contact, whereby impact velocity between the members and stresses in the members are effectively minimized.

10. A device as specified in claim 9 wherein the impacted and impacting members have a common pivot pin.

11. A device as specified in claim 9 wherein said impacted member is resiliently deflectible.

12. A device as specified in claim 9 wherein said first and second pivot means comprises a common pivot element.

* * * * *

UNITED STATES PATENT AND TRADEMARK OFFICE

CERTIFICATE OF CORRECTION

PATENT NO. : 4,003,603

DATED : January 18, 1977

INVENTOR(S) : Orrin A. Stemler and Delwin E. Cobb

It is certified that error appears in the above-identified patent and that said Letters Patent are hereby corrected as shown below:

Column 4, line 63 (Claim 5), after "coaxially" cancel "to" and substitute therefor --of--.

Signed and Sealed this

Seventeenth Day of May 1977

[SEAL]

*Attest:*

RUTH C. MASON
*Attesting Officer*

C. MARSHALL DANN
*Commissioner of Patents and Trademarks*